US008926347B2

(12) United States Patent
Zhu et al.

(10) Patent No.: US 8,926,347 B2
(45) **Date of Patent: *Jan. 6, 2015**

(54) ELECTRONIC CONNECTOR MODULE HAVING AN IMPROVE RELEASING MECHANISM WITH A SIMPLE STRUCTURE

(71) Applicant: Hon Hai Precision Industry Co., Ltd., New Taipei (TW)

(72) Inventors: Jian-Jun Zhu, Kunshan (CN); Qing-Man Zhu, Kunshan (CN); Chien-Chiung Wang, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 13 days.

This patent is subject to a terminal disclaimer.

(21) Appl. No.: 13/906,342

(22) Filed: May 31, 2013

(65) Prior Publication Data

US 2013/0323959 A1 Dec. 5, 2013

(30) Foreign Application Priority Data

May 31, 2012 (CN) ..... 2012 1 0174163

(51) Int. Cl.
*H01R 13/62* (2006.01)
*H01R 13/633* (2006.01)
*H01R 13/627* (2006.01)

(52) U.S. Cl.
CPC ..... *H01R 13/62* (2013.01); *H01R 13/6272* (2013.01); *H01R 13/6335* (2013.01)
USPC ..... 439/159

(58) Field of Classification Search
CPC ..... H01R 13/635; H01R 13/6275
USPC ..... 439/159, 152, 352, 357; 385/92, 53
See application file for complete search history.

(56) References Cited

U.S. PATENT DOCUMENTS

| | | | | |
|---|---|---|---|---|
| 8,444,430 | B2 * | 5/2013 | Kappla et al. | 439/352 |
| 8,500,470 | B2 * | 8/2013 | Wang et al. | 439/159 |
| 8,597,045 | B2 * | 12/2013 | Zhu et al. | 439/357 |
| 8,662,917 | B2 * | 3/2014 | Wang et al. | 439/497 |
| 2012/0164860 | A1 | 6/2012 | Wang et al. | |
| 2012/0164869 | A1 * | 6/2012 | Mizukami et al. | 439/357 |
| 2012/0294571 | A1 * | 11/2012 | Kappla et al. | 385/76 |
| 2013/0288507 | A1 * | 10/2013 | Zhu et al. | 439/345 |
| 2013/0323959 | A1 * | 12/2013 | Zhu et al. | 439/353 |

* cited by examiner

*Primary Examiner* — Phuongchi T Nguyen
(74) *Attorney, Agent, or Firm* — Wei Te Chung; Ming Chieh Chang

(57) ABSTRACT

An electrical connector module for mating with a complementary connector module comprises a housing defining a channel formed on a top surface thereof and a mounting slot recessed downwardly from a bottom surface of the channel; a releasing mechanism received into the channel, the releasing mechanism defines a tab extending into the mounting slot, and an actuator formed on a front end thereof; and a resilient piece received into the mounting slot, the resilient piece having a front end abutting against a front inner surface of the mounting slot and a rear end abutting against the tab; the complementary connector module comprises a latching member locked in the front end of the channel and located above the actuator; the releasing mechanism moves forwardly, the actuator extends into a front end of the channel and raises up the latching member along a vertical direction.

13 Claims, 9 Drawing Sheets

ELECTRONIC CONNECTOR MODULE HAVING AN IMPROVE RELEASING MECHANISM WITH A SIMPLE STRUCTURE

BACKGROUND OF THE INVENTION

1. Field of the Invention

The present invention generally relates to an electrical connector module, and more particularly to an electrical connector module used for high-speed transmission.

2. Description of Related Art

U.S. Patent No. 20120164860 A1 published to Wang on Jun. 28, 2012 discloses a plug connector assembly for latching with a complementary connector module. The connector assembly comprises a housing and a complementary connector module. The complementary connector module defines a latching tab having a latching hole formed thereon. The housing of the plug connector assembly defines a latching nose cooperating with the latching hole. The releasing mechanism comprises a gasket, puller and an operator. The gasket surrounds the housing and defines two resisting beams respectively having a protrusion projecting downwardly thereform. The operator defines two beam portions respectively having a guiding portion projecting upwardly thereform. The latching tab of the complementary connector module is located above the two resisting beams of the gasket. The two resisting beams of the gasket will be raised up by the guiding portions when the two beam portions moves along a front-to-rear direction. As a result, the latching tab will also be raised up by the two protrusions of the resisting beams and disengaged from the latching nose of the housing. Thus, the plug connector assembly is released from the complementary connector.

However, the releasing mechanism aforementioned has complicated structure and is difficult to manufacture. And, the puller and the operator only has a rearward movement manner to achieve an disengagement between the plug connector assembly and the complementary connector module. So, there is some limitations to the present operating manner when a front-to-rear operating space is not ample enough.

Hence, an improved electrical connector module is highly desired to overcome the disadvantages of the related art.

SUMMARY OF THE INVENTION

Accordingly, an object of the present invention is to provide an electrical connector module having a releasing mechanism with a simple structure and easily to operate to disengage with a complementary In order to achieve the object set forth, An electrical connector module for mating with a complementary connector module comprises a housing defining a channel formed on a top surface thereof and a mounting slot recessed downwardly from a bottom surface of the channel for a distance; a releasing mechanism assembled to the housing and received into the channel, the releasing mechanism defines a tab extending into the mounting slot, and an actuator formed on a front end thereof; and a resilient piece received into the mounting slot, the resilient piece having a front end abutting against a front inner surface of the mounting slot and a rear end abutting against the tab; the complementary connector module comprises a latching member locked in the front end of the channel and located above the actuator; the releasing mechanism moves forwardly, the actuator extends into a front end of the channel and raises up the latching member along a vertical direction.

Other objects, advantages and novel features of the invention will become more apparent from the following detailed description when taken in conjunction with the accompanying drawings.

DETAILED DESCRIPTION OF THE INVENTION

Figure 1:
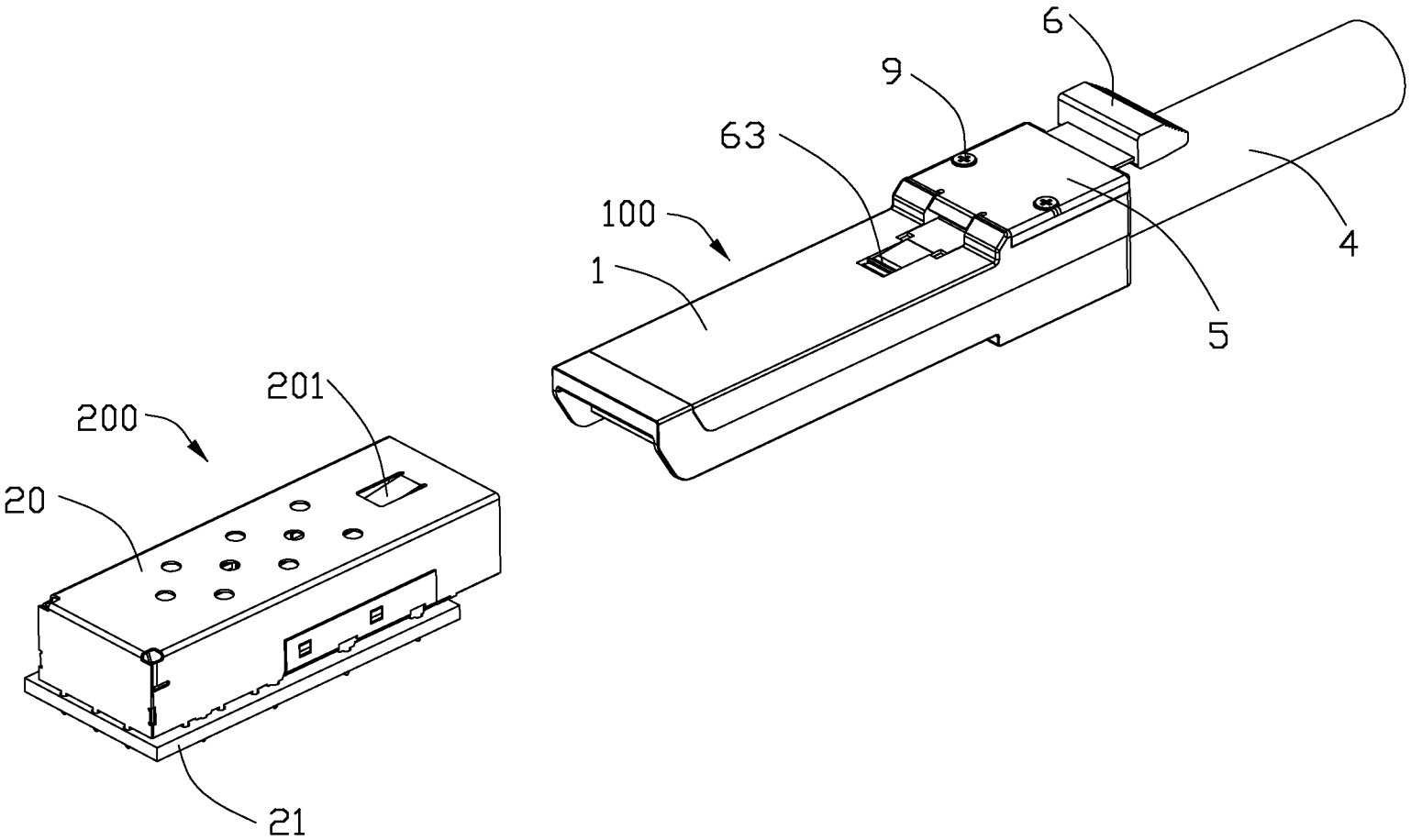
FIG. 1 is a perspective view of an electrical connector module in accordance with the present invention and a complementary connector module unmated with each other.

Reference will now be made in detail to the preferred embodiment of the present invention.

Referring to FIGS. 1 to 9, an electrical connector module 100 in according to the present invention is used for mating with an complementary connector module 200 along a mating direction, The complementary connector module 200 comprises a metallic shell 20 having a latching member 201 extending to an internal space of the metallic shell 20. The electrical connector module 100 comprises an elongated housing 1 having a receiving space 10, a PCB 3 accommodated in the receiving space 10, a releasing mechanism 6 assembled to an exterior surface of the housing 1, a shielding member 5 assembled to the housing 1 and shielding a portion of the releasing mechanism 6 and a cable 4 extending into the receiving space 10 and electrically connected with a rear end of the PCB 3.

Figure 2:
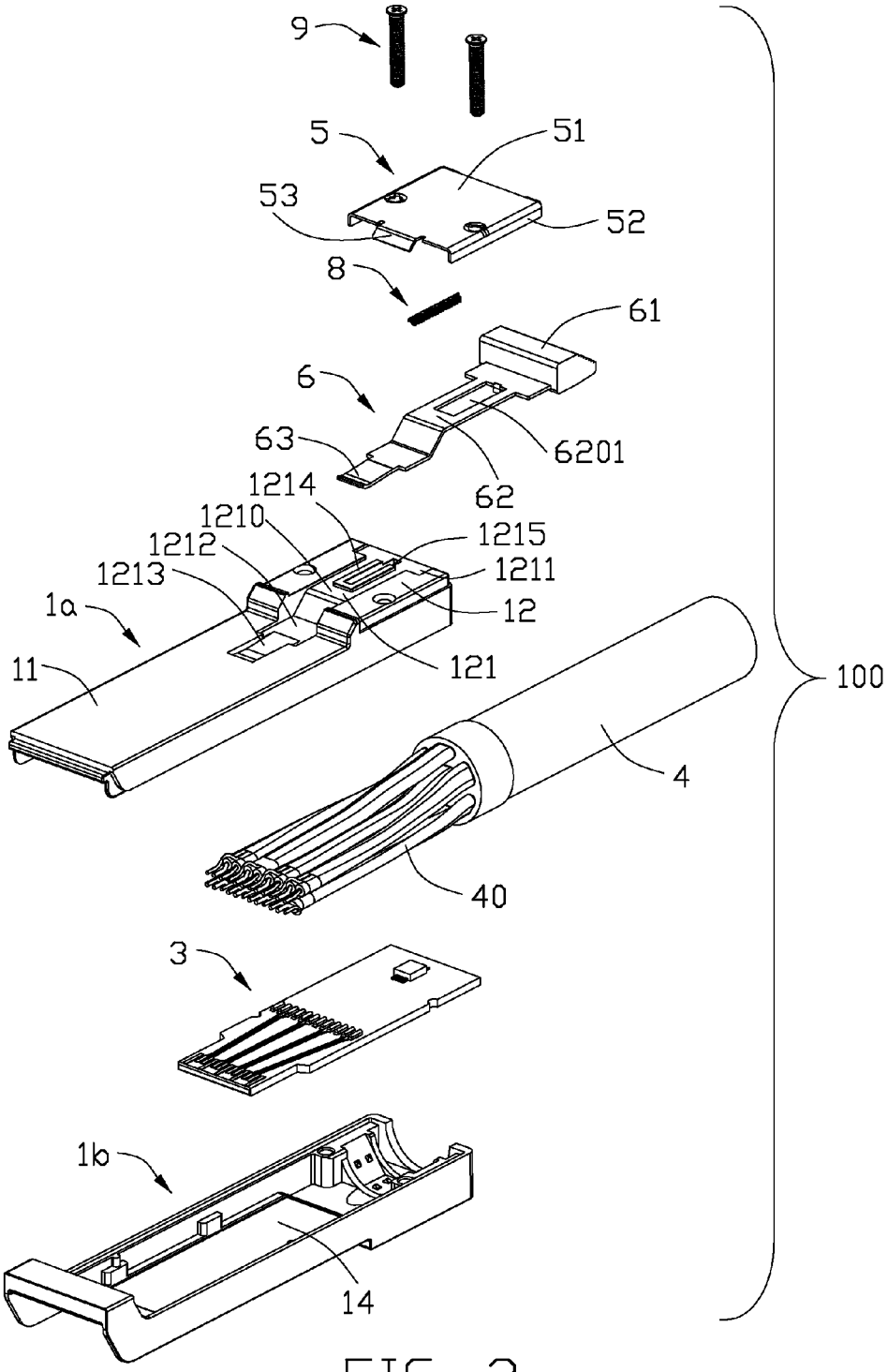
FIG. 2 is an exploded, perspective view of an electrical connector module shown in FIG. 1.
Figure 3:
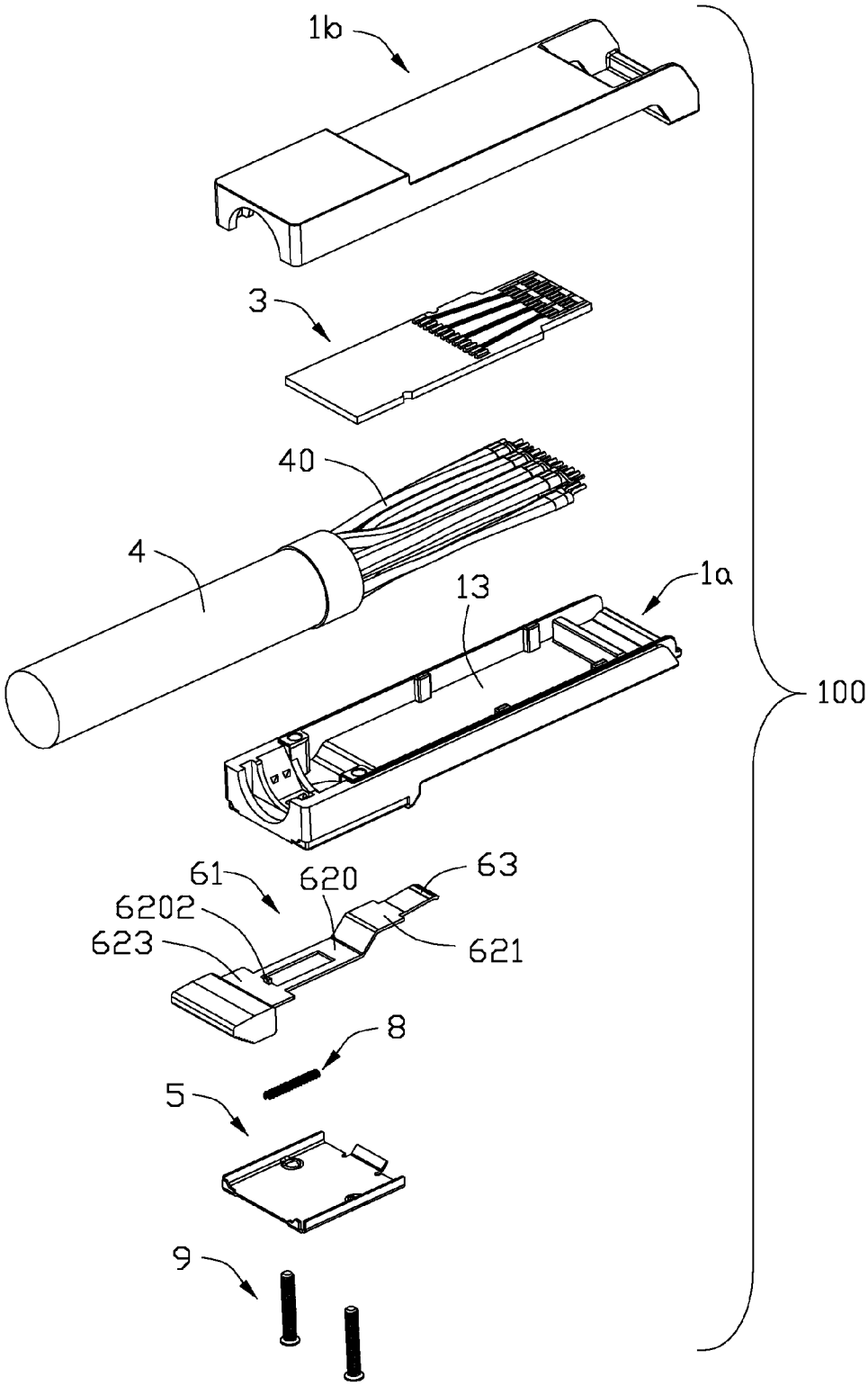
FIG. 3 is a view similar to FIG. 2, but viewed from another aspect.
Figure 4:
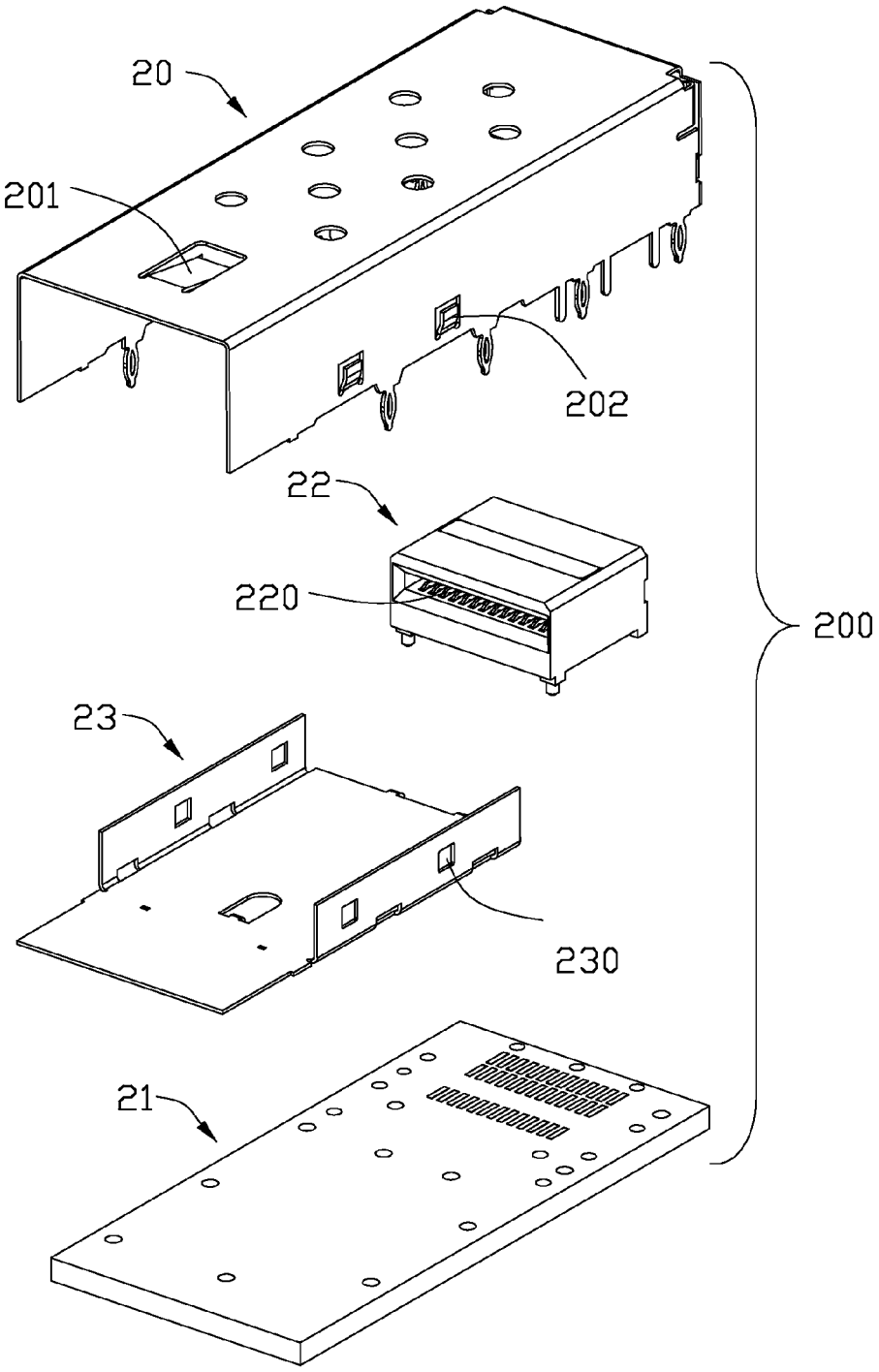
FIG. 4 is an exploded, perspective view of the complementary connector module shown in FIG. 1.
Figure 6:
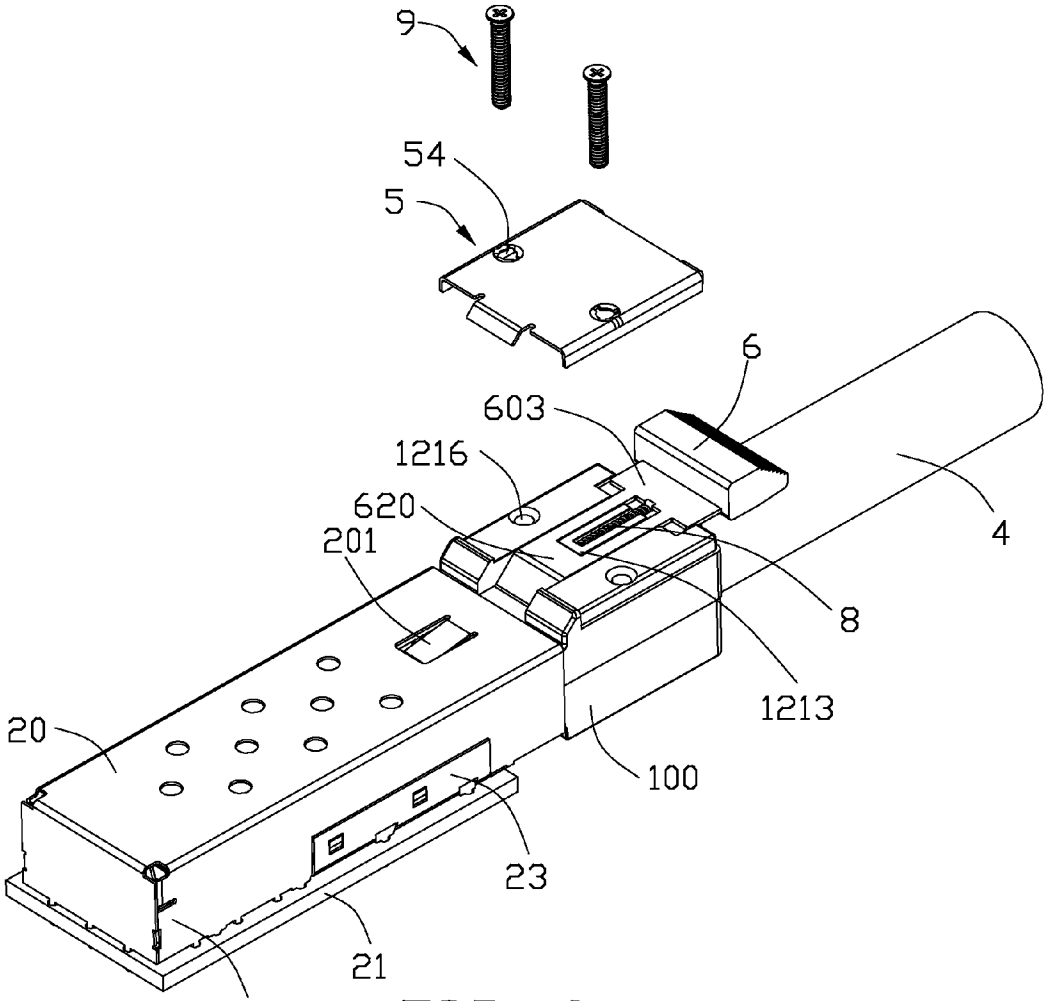
FIG. 6 is a partially assemble perspective view of the electrical connector module and the complementary connector module shown in FIG. 5, with a shielding member unassembled to a housing of the electrical connector module.
Figure 7:
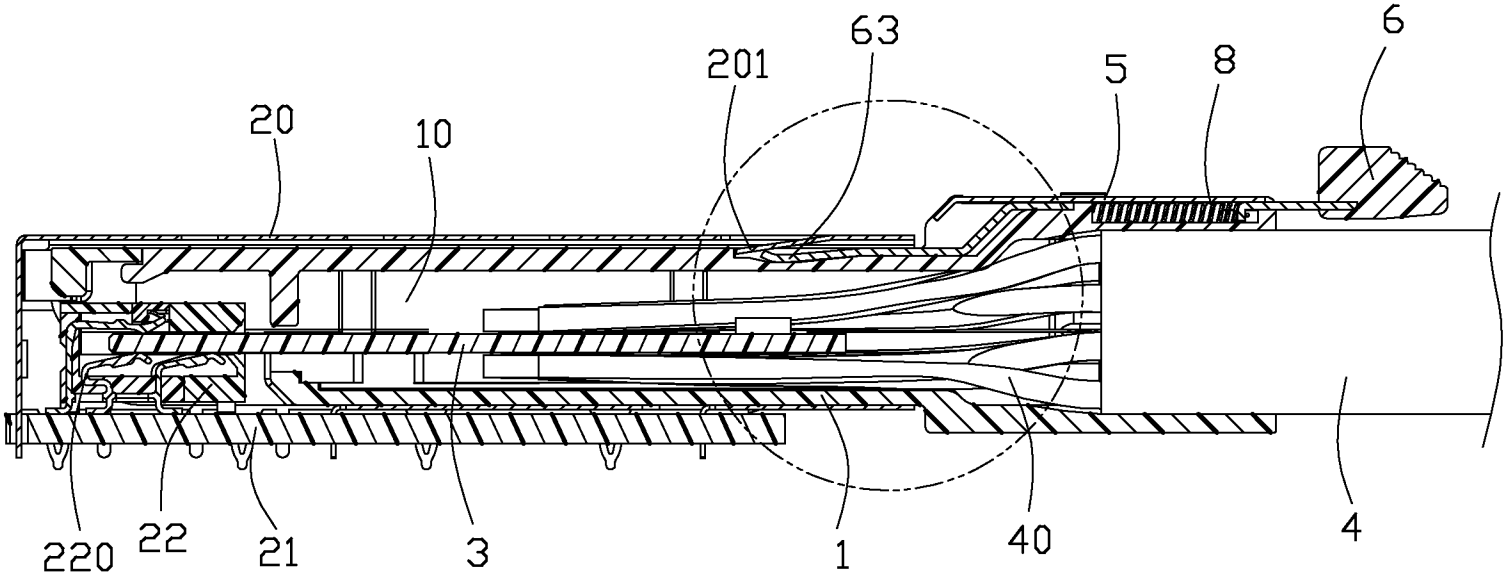
FIG. 7 is a cross-section view taken along line 7-7 of FIG. 5.
Figure 8:
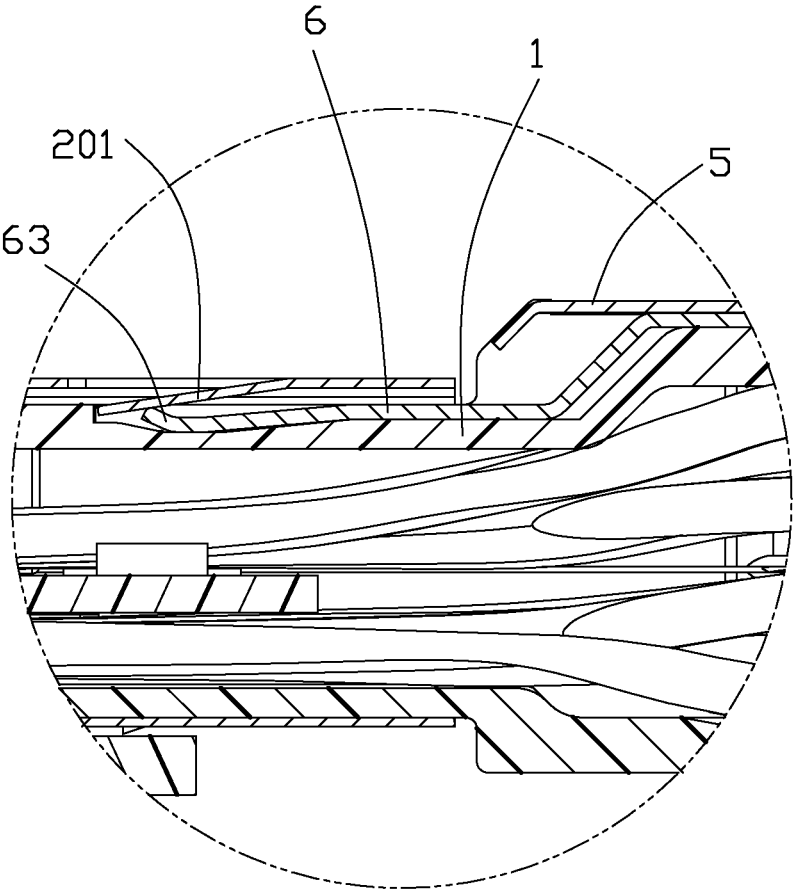
FIG. 8 is an enlarged view of a circle shown in FIG. 7 to clearly show a latching member of the complementary connector module latched with the electrical connector module.
Figure 9:
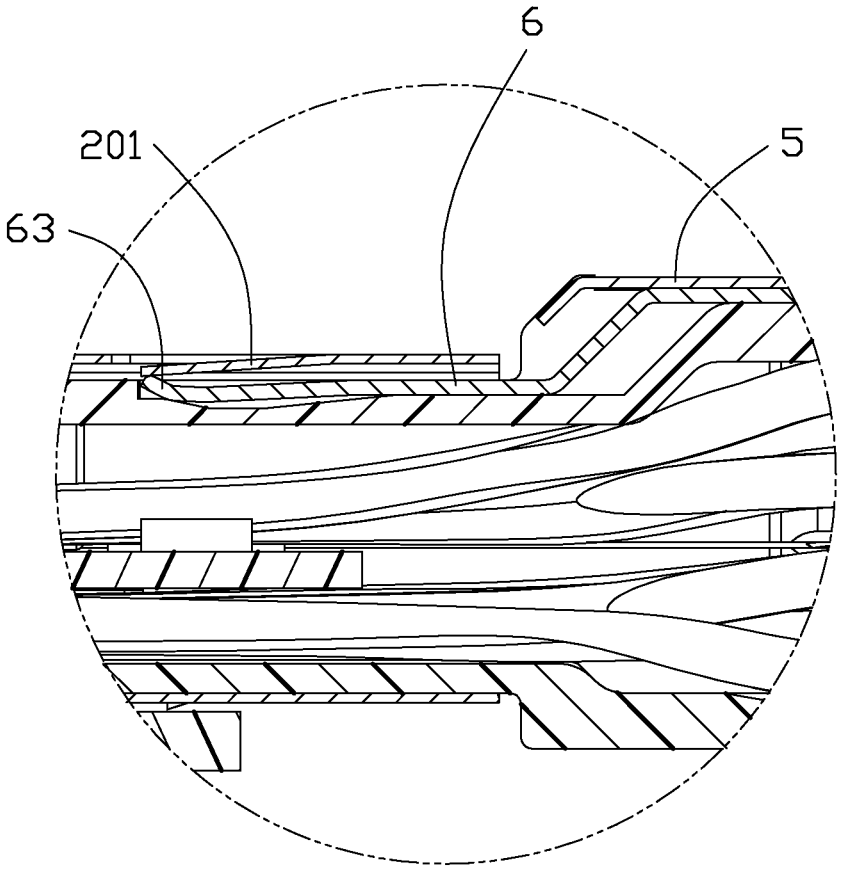
FIG. 9 is a view similar to FIG. 8, the complementary connector module to show the latching member of the complementary connector module released from the electrical connector module.

Referring to FIGS. 2 to 3 and in conjunction with FIG. 6, the housing 1 is made of metallic material and formed in a die-cast manner. The housing 1 comprises a first shield part 1*a* and a second shield part 1*b*. The first shield part 1*a* and the second shield part 1*b* are respectively formed by die-cast manner. The first shield part 1*a* and the second shield part 1*b* respectively defines a first receiving cavity 13 and a second receiving cavity 14. The receiving space 10 of the housing 1 is commonly formed by the first receiving cavity 13 and the second receiving cavity 14. A part of the first and second shield part 1*a*, 1*b* are received into the complementary connector module 200.

Referring to FIGS. 1 to 3 and in conjunction with FIG. 6, the housing 1 has a top surface comprising a horizontal first surface 11 and a horizontal second surface 12. The second surface 12 is located above the first surface 11 and disposed in back of the first surface 11. The first shield part 1*a* has a receiving channel 121 formed on a top surface thereof and extending along a longitudinal direction. The receiving channel 121 is structured in a step shape extending from the second surface 12 to the first surface 11. The receiving channel 121 comprises a horizontal slot 1210, a limiting slot 1211 located in back of the horizontal slot 1210 and communicating with the limiting slot 1211, a connecting slot 1212 extending downwardly and forwardly from the horizontal slot 1210 and an extending slot 1213 extending forwardly from the connecting slot 1212. The extending slot 1213 is deeper than the connecting slot 1212. The horizontal slot 1210 and the limiting slot 1211 are located on the second surface 12. The connecting slot 1212 is lower than the horizontal slot 1210 and extending from the second surface 12 to the first surface 11. The extending slot 1213 is located on the first surface 11 and has a curved bottom surface. A protruding portion 1214 is formed on a bottom of the horizontal slot 1210. A mounting slot 1215 is recessed downwardly from a top surface of the protruding portion 1214 for a distance. The first shield part 1*a* defines two screw holes 1216 throughout top and bottom surface thereof Referring to FIGS. 2 to 3, the releasing mechanism 6 comprises a rear operating portion 61, an front actuator 63 and a connecting portion 62 connecting with the operating portion 61 and the actuator 63. The rear operating portion 61 is made of insulative material. The connecting portion 62 and the actuator 63 are made of metallic material. The insulative operating portion 61 is integrative formed with the metallic connecting portion 62. The releasing mechanism 6 is assembled to the top surface of the housing 1. The operating portion 61 extends out of a rear surface of the housing 1. The connecting portion 62 comprises a horizontal body portion 620, a stop portion 623 extending rearward from the body portion 620 and connecting with the operating portion 61 and a resistant portion 621 extending forwardly and downwardly from the body portion 620. The resistant portion 621 has two section with different widths. The actuator 63 is structured in a curved shape and accommodated in the extending slot 1213. The body portion 620 of the connecting portion 62 has an opening 6201 and a tab 6202 extending downwardly from the rear end of the opening 6201 and extending into the mounting slot 1215. The body portion 620 of the connecting portion 62 is accommodated into the horizontal slot 1210, the resistant portion 621 is accommodated into the extending slot 1213, the actuator 63 is accommodated in the extending slot 1213. The opening 6201 is cooperated with the protruding portion 1214. There is a gap between the opening 6201 and the protruding portion 1214. Thus, a relatively movement between the protruding portion 1214 and the opening 6201 can be achieved. The protruding portion 1214 is used to limit a movement of the releasing mechanism 6 along a front-to-rear direction.

A resilient piece 8 is received into the mounting slot 1215. The resilient piece 8 has a front end abutting against a front inner surface of the mounting slot 1215 and a rear end abutting against the tab 6202 of the releasing mechanism 6. While a forwardly force is exerted to the operating portion 61 of the releasing mechanism 6, the resilient piece 8 will be compressed by the tab 6202 of the releasing mechanism 6. While a forwardly force is released, the resilient piece 8 will resume to an original state to make the releasing mechanism 6 resume to an original position. In one embodiment, the resilient piece 8 is a spring.

The shielding member 5 comprises a top wall 51 and two side walls 52 extending downwardly from two lateral sides of the top wall 51 and a rear wall 53 extending downwardly from a rear side of the top wall 51. The housing defines a pair of screw holes 1216, The top wall 51 has a pair of mounting holes 54 corresponding with the screw holes 1216 in a vertical direction, a pair of screws 9 are inserted into the screw holes 1216 of the first shielding part 1*a* by passing through the mounting holes 54 of the shielding member 5 and extending into the second shield part 1*b*. Thus, the shielding member 5, the first shield part 1*a* and the second shield part 1*b* are interconnected with each other along a vertical direction.

Figure 5:
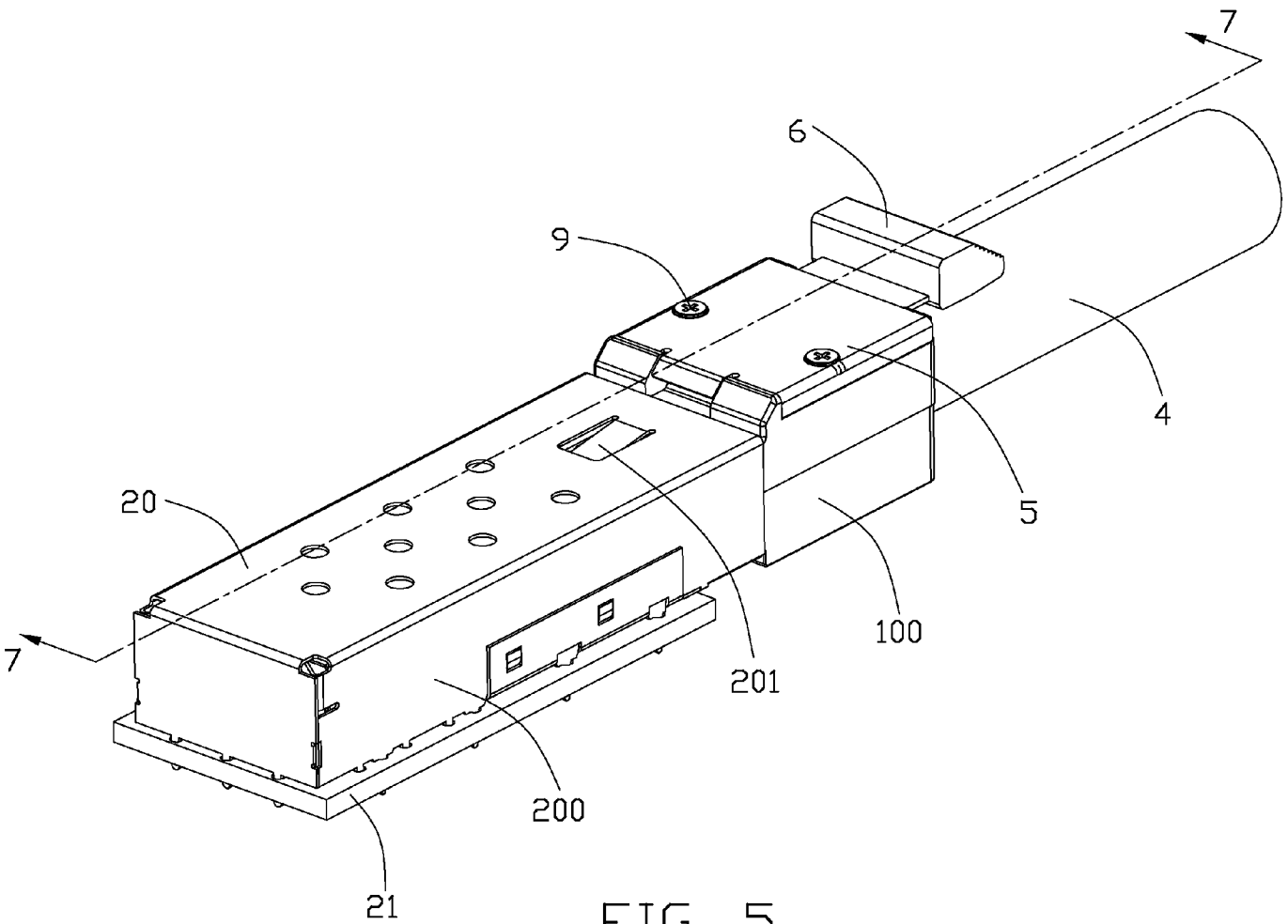
FIG. 5 is a perspective view of the electrical connector module and a complementary connector module shown in FIG. 1 mated with each other.

Referring to FIG. 5, the latching member 201 of the complementary connector module 200 is stamped by a part of top wall of the metallic shell 20 of the complementary connector module 200. The complementary connector module 200 further comprises a bottom shell 23 located below and assembled with the metallic shell 20, a housing 22 received into the metallic shell 20 and a PCB 21 located below and connected with the metallic shell 20. A number of contacts 220 are received into the housing 22 and electrically connected to the PCB 21. The metallic shell 20 defines locking tabs 202 respectively formed on side walls cooperated with openings 230 formed on two lateral sides of the bottom shell 23.

Referring to FIGS. 5 to 9, when the electrical connector module 100 are mated with the complementary connector module 200, the PCB 3 of the electrical connector module 100 are electrical connected with the contacts 220 of the complementary connector module 200. The latching member 201 of the complementary connector module 200 are locked in the extending slot 1213 of the housing 1 to achieve an engagement between the electrical connector module 100 and the complementary connector module 200. The latching member 201 is located above the actuator 63. When the releasing mechanism 6 of the electrical connector module 100 moves forwardly by a force, the resilient piece 8 is compressed by the tab 6202, and the actuator 63 extends forwardly and upwardly along a bottom surface of the extending slot 1213. Thus, the locking tab 201 is raised up by the actuator 63 of the releasing mechanism 6 and extending out of the extending slot 1213. As a result, the electrical connector module 100 is disengaged with the complementary connector module 200. When the force is released, the releasing mechanism 6 is resumed to an original state by the resilient piece 8.

The electrical connector module 100 in according to the present invention has a simple releasing mechanism 6 and is easily to operate to disengage with the complementary connector module.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector module for mating with a complementary connector module comprises:

a housing defining a channel formed on a top surface thereof and a mounting slot recessed downwardly from a bottom surface of the channel for a distance;

a releasing mechanism assembled to the housing and received into the channel, the releasing mechanism defines a tab extending into the mounting slot, and an actuator formed on a front end thereof; and a resilient piece received into the mounting slot, the resilient piece having a front end abutting against a front inner surface of the mounting slot and a rear end abutting against the tab;

the complementary connector module comprises a latching member locked in the front end of the channel and located above the actuator;

wherein the releasing mechanism moves forwardly, the actuator extends into a front end of the channel and raises up the latching member along a vertical direction;

wherein the connecting portion of the releasing mechanism defines an opening, a protruding portion is formed in the channel and cooperated with the opening to limit the movement of the releasing mechanism along a front-to-rear direction;

wherein the electrical connector module further comprises a PCB received into the housing and a cable received into the housing and electrically connected to the PCB;

the resilient piece is a compression spring.

2. The electrical connector module as claimed in claim 1, wherein the releasing mechanism further comprises a rear operating portion and a connecting portion connected with the rear operating portion and the actuator.

3. The electrical connector module as claimed in claim 1, wherein the front end of the channel has a curved bottom surface, and the actuator is structured in a curved shape and accommodated into the front end of the channel.

4. The electrical connector module as claimed in claim 1, wherein the top surface is formed by a first surface and a second surface, the second surface is located above the first surface and disposed in back of the first surface, the channel extends from the second surface to the first surface.

5. The electrical connector module as claimed in claim 1, wherein the mounting slot is recessed downwardly from a top surface of the protruding portion.

6. The electrical connector module as claimed in claim 1, wherein the housing comprises a first shield part and a second shield part assembled with each other along a vertical direction.

7. The electrical connector module as claimed in claim 1, wherein the electrical connector module further comprises a shielding member assemble to the top surface of the housing and shielding a portion of the releasing mechanism.

8. An electrical connector module for mating with a complementary connector module comprises:

a metallic housing having a main portion and a mating portion extending forwardly from the main portion and received into the complementary connector module, the housing defining a channel extending from a top surface of the main portion to a top surface of the mating portion;

a releasing mechanism received into the channel, and being capable of movable along a rear-to front direction; and a resilient piece located in the channel and attached to a portion of the releasing mechanism;

wherein when a pushing force is exerted on a rear end of the releasing mechanism, a front end of the releasing mechanism is moved upwardly and forwardly, when a pushing force is released, the releasing mechanism IS resumed to an original state by a restoration force of the resilient piece;

wherein a mounting slot is formed in the channel, the resilient piece is received into the mounting slot;

wherein the portion of the releasing mechanism extending into the mounting slot and abutting against the resilient piece;

wherein the releasing mechanism defines an opening, a protruding portion formed in the channel and cooperated with the opening, a forwardly movement of the releasing mechanism is limited by the protruding portion;

the resilient piece is a compression spring.

9. The electrical connector module as claimed in claim 8, wherein the main portion is larger than the mating portion.

10. An electrical connector assembly for use with a complementary connector having a metallic shell with a deflectable latching member thereon, comprising:

a housing defining opposite first and second surfaces in a vertical direction, and a front mating portion and rear main portion in a front-to-back direction perpendicular to said vertical direction;

a cable extending rearwardly from a rear end of the main portion;

an extending slot formed in the first surface with a latching region, at a front end, for locking said latching member of the complementary connector;

a releasing mechanism mounted upon and located around the first surface and back and forth moveable along said front-to-back direction between opposite front and rear positions, said releasing mechanism including at a front end an actuating region moveable in the extending slot and at a rear end an pressing region configured to be adapted to be forwardly pushed by a thumb; and a resilient piece linked between the housing and the releasing mechanism to urge the releasing mechanism to move rearwardly when the releasing mechanism is forwardly pushed to the front position via said pressing region;

wherein said actuator defines a tip dimension and configured to be adapted to abut against an inner face of the latching member to push latching member outwardly away from the latching region when said latching mechanism is moved to the front position;

wherein said first surface faces upwardly and said pressing region defines an rearwardly and upwardly oblique pressing surface;

wherein said housing defines a mounting slot to receive said resilient piece;

the resilient piece is a compression spring.

11. The electrical connector assembly as claimed in claim 10, wherein the releasing mechanism defines outer and inner levels in the vertical direction to comply with a step structure of the first surface, and the actuator is located at an inner level while the resilient piece is linked at the outer level.

12. The electrical connector assembly as claimed in claim 10, wherein the first surface is configured to raise the actuator outwardly away from the housing in the vertical direction when said releasing mechanism is moved to the front position.

13. The electrical connector assembly as claimed in claim 10, wherein said releasing mechanism defines an opening in alignment with the mounting slot to receive therein a protrusion formed on a periphery of said mounting slot.

* * * * *